United States Patent [19]

Watanabe

[11] 4,111,615

[45] Sep. 5, 1978

[54] FLUID EXHAUSTING DEVICE

[75] Inventor: Iwao Watanabe, Kadoma, Japan

[73] Assignee: Matsushita Electric Industrial Company, Limited, Japan

[21] Appl. No.: 697,123

[22] Filed: Jun. 17, 1976

[30] Foreign Application Priority Data

| | | | |
|---|---|---|---|
| Jun. 18, 1975 | [JP] | Japan | 50-74854 |
| Sep. 30, 1975 | [JP] | Japan | 50-134510[U] |
| Sep. 30, 1975 | [JP] | Japan | 50-134516[U] |
| Sep. 30, 1975 | [JP] | Japan | 50-134520[U] |

[51] Int. Cl.[2] ..... F04B 17/00

[52] U.S. Cl. ..... 417/423 A; 415/119; 415/210; 417/366

[58] Field of Search ..... 415/208, 209, 210, 119; 417/423 A, 366

[56] References Cited

U.S. PATENT DOCUMENTS

| | | | |
|---|---|---|---|
| 2,245,179 | 6/1941 | Boivie | 415/210 |
| 2,272,985 | 2/1942 | Smith | 417/423 A |
| 2,726,807 | 12/1955 | Lewis | 417/423 A |
| 2,731,194 | 1/1956 | Kent | 417/423 A |
| 3,082,940 | 3/1963 | Frantz | 417/423 A |
| 3,117,770 | 1/1964 | Campbell | 415/210 |
| 3,346,174 | 10/1967 | Lievens et al. | 415/210 |
| 3,454,978 | 7/1969 | Kuwahara | 417/423 A |
| 3,976,393 | 8/1976 | Larson | 415/210 |

FOREIGN PATENT DOCUMENTS

| | | | |
|---|---|---|---|
| 624,844 | 7/1927 | France | 417/423 A |
| 1,600,841 | 4/1970 | France | 415/119 |
| 282,797 | 10/1928 | United Kingdom | 415/210 |
| 908,521 | 10/1962 | United Kingdom | 415/119 |
| 983,469 | 2/1965 | United Kingdom | 415/119 |

*Primary Examiner*—C. J. Husar

*Attorney, Agent, or Firm*—Robert E. Burns; Emmanuel J. Lobato; Bruce L. Adams

[57] ABSTRACT

A centrifugal fluid exhausting device for use, by way of example, in a portable vacuum cleaner, comprising a centrifugal fan driven by an electric motor and housings enclosing the fan and the motor, characterized in that the paths of fluid between the fan and the fan housing and between the motor and the motor housing are streamlined to reduce the resistances to the flows of fluid therethrough.

24 Claims, 11 Drawing Figures

FIG. 2 PRIOR. ART
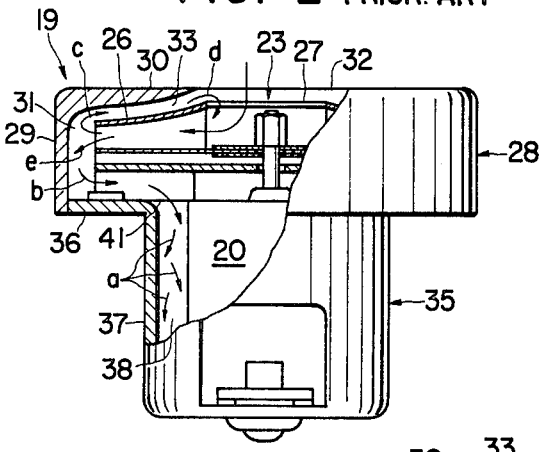
FIG. 3
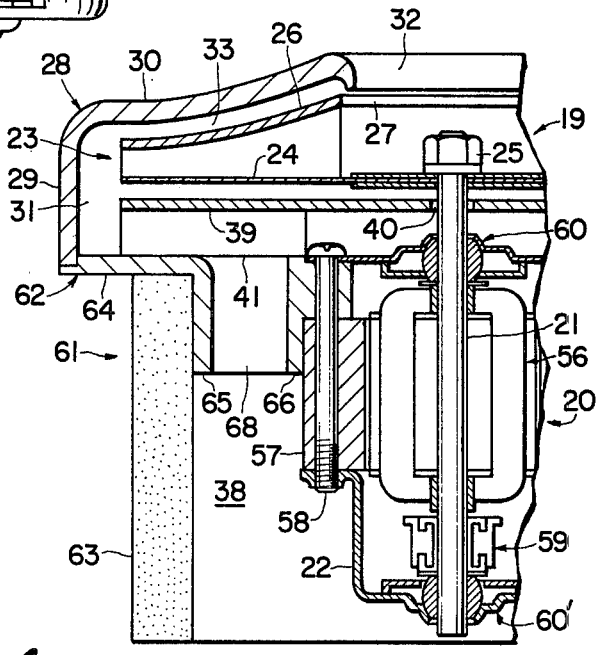
FIG. 4
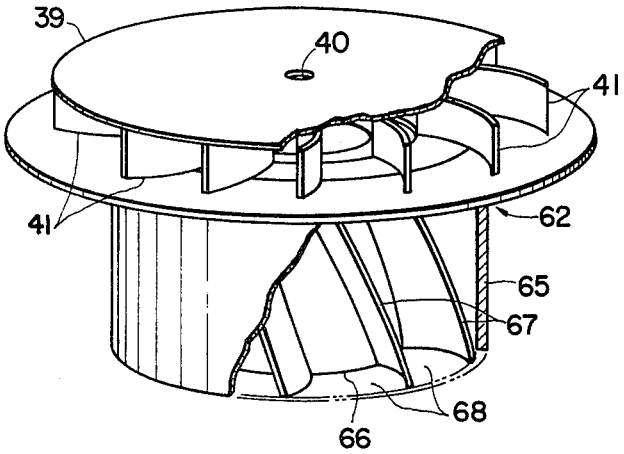

FLUID EXHAUSTING DEVICE

BACKGROUND OF THE INVENTION

The present invention relates to a fluid exhausting device such as, typically, an air exhausting unit of a portable vacuum cleaner for removing dust and dirt from floors, walls, furniture, upholstery or other surfaces by air suction.

An air exhausting unit of a portable vacuum cleaner for household or office use or for use in an automotive vehicle is ordinarily of the type which comprises a centrifugal fan including a motor-driven rotor formed with a central opening having a center axis coincident with the axis of rotation of the rotor and a number of rotor blades extending radially outwardly from the central opening. The rotor is enclosed within a coaxial rotor housing which has an annular front wall portion formed with an air inlet opening located immediately upstream of the central opening in the rotor and a cylindrical side wall portion which defines an annular passageway encircling the rotor for collecting the air delivered from the rotor. The rotor is driven for rotation about its axis by an electric motor which is positioned on the leeward side of the rotor. The motor is enclosed within a motor housing which is fixedly secured to the rotor housing so that a generally cylindrical air outlet passageway in constant communication with the annular passageway in the rotor housing is provided around the motor. Between the annular passageway in the rotor housing and the cylindrical passageway in the motor housing are located a plurality of stationary outlet guide vanes which are arranged to establish spiral flows of air at the entrance to the cylindrical air outlet passageway. The flow of air in the motor housing is discharged to the atmosphere usually from the rear end of the outlet passageway.

In an air exhausting device of the above described construction, the flows of air past the outlet guide vanes are subjected to no compulsive spinning actions in the absence of guide means downstream of the vanes and, as a consequence, turbulence is produced in the outlet passageway in the motor housing by the externally projecting parts of the motor disrupting the stream of air through the passageway. The turbulent flows thus induced on the leeward side of the fan are not only the important cause of noises but tend to reduce the horsepower taken by the fan and will deteriorate the performance efficiency of the fan.

SUMMARY OF THE INVENTION

It is, accordingly, a first object of the present invention to provide an improved fluid exhausting device having additional guide means located downstream of the guide vanes between the passageways in the rotor and motor housings.

The guide vanes are usually secured to the internal surfaces of the motor housing by fittings projecting from the vanes. The fittings are located in the air flow paths provided between the individual guide vanes and disrupt the lines of flow of air along such paths. This also contributes to production of noises and deterioration of the performance efficiency of the fan located on the windward side of the guide vanes.

It is, therefore, a second object of the present invention to provide an improved fluid exhausting device in which the air flow paths formed between the guide vanes are streamlined and will not disrupt the streams of fluid along the guide vanes.

The rotor of the fan being rotatable relative to the rotor housing which is held stationary, there is provided an annular clearance between the rotor and the inner surface of the annular front wall portion of the rotor housing. Constant communication is provided between the above-mentioned annular passageway in the rotor housing and the central opening in the rotor through such a clearance and, as a consequence, the streams of air entering the annular passageway surrounding the rotor are allowed to recirculate or "blow back" through the clearance into the central opening in the rotor due to the suction built up in the opening and the pressure developed in the annular passageway. The recirculated air causes reduction of the suction at the entrance to the rotor and will materially impair the air horsepower performance of the fan. The blowback of air into the rotor is also responsible for the production of noises.

It is, thus, a third object of the present invention to provide an improved fluid exhausting device which is provided with means adapted to prevent, or minimize, the recirculation or blowback of air through the clearance between the rotor and the rotor housing.

The streams of air spurting generally tangentially from the radially outer ends of the rotor blades are caused to forcefully impinge upon the inner peripheral surface of the cylindrical side wall portion of the rotor housing defining the annular passageway around the rotor. The air streams are then re-directed away from the inner peripheral surface of the side wall portion and resist the flows of air subsequently delivered from the rotor. This also gives rise to a decrease in the performance efficiency of the fan and contributes to production of noises.

It is, therefore, a fourth object of the present invention to provide an improved fluid exhausting device which is provided with means adapted to produce smooth flows of fluid through the annular passageway around the rotor of the fan.

A prime object of the present invention is, thus, to provide a fluid exhausting device which is improved to have streamlined paths of fluid throughout the passageways between the inlet and outlet of the device so as to reduce the noises produced from the device and provide an increased air exhausting efficiency of the device.

In accordance with the present invention, the above described first object of the invention is achieved in a fluid exhausting device which comprises in combination a centrifugal fan unit including a rotor having an axis of rotation and formed with a central opening having a center axis substantially coincident with the axis of rotation and a plurality of rotor blades extending radially outwardly from the central opening and a rotor housing enclosing the rotor and having a generally cylindrical side wall portion defining an annular passageway substantially coaxially surrounding the rotor and an end wall portion located on one side of the rotor and formed with a fluid inlet opening adjacent the central opening in the rotor, the end wall portion being spaced apart from the rotor in a direction parallel with the axis of rotation of the rotor for forming an annular clearance between the end wall portion and the rotor, a driving unit positioned on the other side of the rotor and drivingly connected to the rotor, a housing structure fixedly secured to the rotor housing and enclosing the driving unit for providing a fluid outlet passageway surrounding at least part of the driving unit and in constant communication with the above-mentioned annular passageway in the rotor housing, the housing structure being formed with at least one opening through which the outlet passageway is vented to the atmosphere, a plurality of stationary first guide vanes located between the annular passageway in the rotor housing and the outlet passageway in the housing structure, and a plurality of stationary second guide vanes located in the outlet passageway immediately downstream of the first guide vanes, the first and second guide vanes extending generally radially about an extension of the axis of rotation of the rotor. Preferably, the second guide vanes are curved forwardly in the direction of rotation of the rotor and are, more preferably, inclined to the extension of the axis of rotation of the rotor so that each of the second guide vanes has its upstream axial end located forwardly of its downstream axial end in the direction of rotation of the rotor. The first guide vanes are also preferably curved forwardly in the direction of rotation of the rotor. Furthermore, the housing structure may comprise a bracket including radially spaced, coaxial inner and outer cylindrical portions surrounding part of the driving unit and located immediately downstream of the first guide vanes. In this instance, the second guide vanes are fixedly connected between the inner and outer cylindrical wall portions of the bracket.

To achieve the previously described second object of the present invention, the above-mentioned housing structure has an annular portion extending along the downstream end of the side wall portion of the rotor housing and a plurality of radial projections extending radially outwardly from the outer circumference of the annular portion, the annular portion being formed with depressions each having a bottom face located at the downstream end of the annular passageway around the rotor and substantially flush with and merging into one end surface of each of the radial projections, each of the first guide vanes of the same number as the radial projections having a leg portion partly bent substantially perpendicularly from the downstream end of a radially outer end portion of the first guide vane and partly projecting radially outwardly from the first guide vane, the leg portion having a thickness substantially equal to the depth of each of the depressions and having a configuration substantially identical partly with the bottom face of each depression and partly with said end face of each of the radial projections, each of the leg portions being partly received in each of the depressions and partly received on the end face of each of the radial projections.

To achieve the previously described third object of the present invention, the fluid exhausting device having the basic construction above set forth further comprises at least one circular rib located within the annular clearance between the rotor and the inner surface of the end wall portion of the rotor housing for thereby preventing backflow of fluid from the annular passageway into the central opening in the rotor through the above-mentioned annular clearance. The rib may be formed on either or each of the rotor and the inner surface of the end wall portion of the rotor housing.

To achieve the fourth object of the present invention as previously noted, the rotor housing is formed with a plurality of spiral ribs on the inner peripheral surface of the side wall portion of the housing, the ribs extending substantially coaxially about the axis of rotation of the rotor.

BRIEF DESCRIPTION OF THE DRAWINGS

The features and advantages of the fluid exhausting device according to the present invention will be more clearly understood from the following description taken in conjunction with the accompanying drawings in which like reference numerals designate similar parts, members and units and in which:

FIG. 2 is a schematic, partially cutaway view showing the flows of air in the air exhausting device of the vacuum cleaner illustrated in FIG. 1;

FIG. 3 is a fragmentary view showing a first preferred embodiment of the present invention;

FIG. 4 is a partially cutaway perspective view showing part of the embodiment of FIG. 3;

DESCRIPTION OF THE PREFERRED EMBODIMENTS

Figure 1:
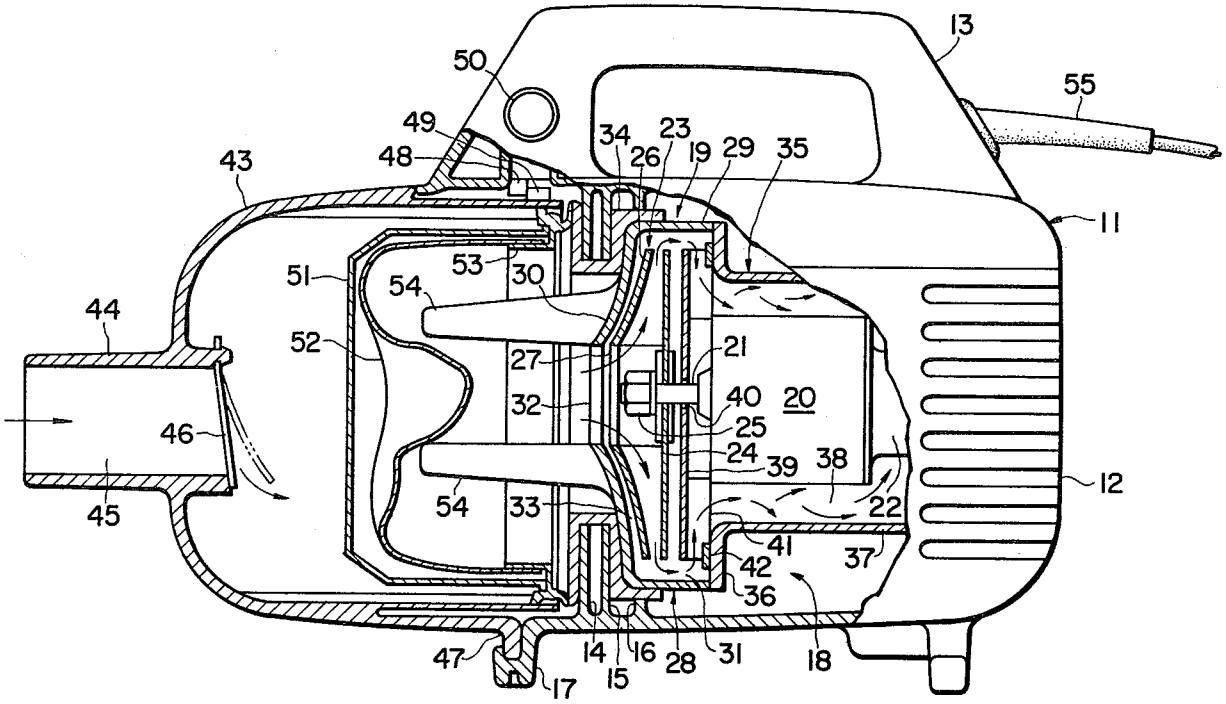
FIG. 1 PRIOR ART
FIG. 1 is a longitudinal sectional view of a representative example of a portable vacuum cleaner incorporating a prior art air exhausting device to which the present invention appertains.

Description will be hereinafter made with reference to the drawings, first to FIG. 1 which illustrates a representative example of a portable vacuum cleaner incorporating a known air exhausting device. The vacuum cleaner comprises a casing 11 including a body 12 and a handle 13 integral with or fixedly secured to the body 12. The body 12 is open at its front end and has a rear wall portion formed with a suitable number of air discharge openings (not shown). For the reason that will be explained later, the body 12 is further formed with annular internal wall portions 14, 15 and 16 adjacent its open front end and a grooved external wall portion 17 at the open front end, as shown. The casing 11 is usually constructed of hard synthetic resin.

An air exhausting unit designated in its entirety by reference numeral 18 is enclosed within the body 12 of the casing 11 and comprises a centrifugal fan unit 19 and an electric motor 20 having an output shaft 21. The motor 20 is supported by a stationary bracket 22 which is fixedly secured to the rear wall portion of the body 12 of the casing 11, as is partially seen in FIG. 1. The centrifugal fan unit 19 comprises a motor-driven rotor 23 having an axis of rotation in line with the axis of the output shaft 21 of the motor 20. The rotor 23 includes a circular rotor disc 24 secured to the output shaft 21 of the motor 20 by a nut 25 and a plurality of rotor blades 26 extending radially inwardly from the outer circumferential end of the rotor disc 24 so as to form radially internally of the blades 26 a generally circular central opening 27 which has a center axis substantially coincident with the axis of rotation of the rotor 23 and accordingly with the axis of rotation of the output shaft 21 of the motor 20. The rotor blades 26 are usually curved forward in the direction of rotation of the rotor 23. The rotor 23 thus constructed is enclosed within a rotor housing 28 which consists of a generally cylindrical side wall portion 29 and a generally annular front end wall portion 30. The cylindrical side wall portion 29 of the rotor housing 28 has an inner peripheral surface radially outwardly spaced apart from the rotor 23 for defining an annular passageway 31 substantially coaxially surrounding the rotor 23. The front end wall portion 30 of the rotor housing 28 is located on the front side of the rotor 23 and is formed with an air inlet opening 32 adjacent to the central opening 27 in the rotor 23, the air inlet opening 32 being shown to be precisely in alignment with the central opening 27 in the rotor 23. The front end wall portion 30 of the rotor housing 28 is forwardly spaced apart from the rotor 23 so that a generally annular clearance 33 is formed between the front ends of the rotor blades 26 and the inner surface of the end wall portion 30 as shown and provides constant communication between the air inlet opening 32 in the rotor housing 28 and the annular passageway 31 around the rotor 23. The rotor housing 28 is held in position relative to the casing 11 of the vacuum cleaner by means of a generally ring-shaped retaining member 34 which is closely fitted to the previously mentioned internal wall portions 14, 15 and 16 of the body portion 12 of the casing 11. The air inlet opening 32 in the rotor housing 28 is thus located slightly internally of the open front end of the body 12 of the casing 11.

The motor 20 is enclosed within a motor housing 35 which has a flange portion 36 fixedly secured to the rear end of the cylindrical side wall portion 29 of the rotor housing 28 and a cylindrical wall portion 37 extending axially rearwardly from the inner circumferential end of the flange portion 36. The cylindrical wall portion 37 of the motor housing 35 has an inner peripheral surface radially outwardly spaced apart from the motor 20, or more specifically, from the casing of the motor 20 and thus forms a generally cylindrical air outlet passageway 38 around the motor housing 35. The air outlet passageway 38 is in constant communication with the annular passageway 31 around the rotor 23 and is open to the atmosphere through openings (not shown) which are formed in the motor housing 35 and the body 12 of the cleaner casing 11.

Between the rotor 23 and the motor 20 is positioned a stationary disc member 39 having a central opening 40 through which the output shaft 21 of the motor 20 forwardly extends for connection to the disc 24 of the rotor 23. The stationary disc member 39 is spaced apart a suitable distance from the front face of the annular wall portion 36 of the motor housing 35 and has integrally connected to or fixedly mounted on its rear face a plurality of stationary guide vanes 41 which extend generally in radial directions of the disc member 38 and which are arranged substantially symmetrically about the axis of rotation of the output shaft 21 of the motor 20, viz., about an extension of the axis of rotation of the rotor 23. The guide vanes 41 are slightly curved forwardly in the direction of rotation of the rotor 23. Each of the guide vanes 41 thus arranged is formed with a leg portion 42 which is perpendicularly bent from a radially outer end portion of the vane and which is fixedly secured to the front face of the annular wall portion 36 of the motor housing 35 by means of an adhesive, for example. The guide vanes 41 are substantially equiangularly spaced apart from each other about the axis of the output shaft 21 of the motor 20 and provide a plurality of air passageways between the annular passageway 31 around the rotor 23 and the cylindrical air outlet passageway 38 around the motor 20.

The above described rotor 23, rotor housing 28, motor housing 35, disc member 38 and guide vanes 39 are usually all constructed of hard synthetic resins.

With the air exhausting unit 18 thus constructed and arranged, the portable vacuum cleaner further comprises a dust receptacle 43 having an open rear end and a front tubular portion 44 formed with a suction hole 45. The front tubular portion 44 has mounted at its inner end a pliable one-way check valve 46 which is elastically deformable between a position closing the inner end of the suction hole 45 as indicated by full lines and a position opening the inner and of the hole 45 as indicated by phantom lines. The receptacle 43 is formed with an external projection 47 at its rear end and is detachably connected to the cleaner casing 11 with the projection 47 disengageably received in the previously mentioned grooved wall portion 17 of the casing 11. The casing 11 and the dust receptacle 43 are further formed with pawl portions 48 and 49, respectively, and are connected to and disconnected from each other through engagement and disengagement between the pawl portions 48 and 49 which are moved relative to each other by manipulating a push button 50 mounted on the handle 13 of the cleaner casing 11.

Within the dust receptacle 43 are removably disposed a generally cup-shaped primary filter element 51 and a generally bag-shaped flexible secondary filter element 52 located within the primary filter element 51. The primary and secondary filter elements 51 and 52 are positioned to have their respective open ends located in front of the fan unit 19 of the air exhausting device 18 and are detachably mounted on the receptacle 43 by a ring-shaped filter support member 53 received on the inner peripheral surface of the rear end portion of the receptacle 43 as shown. The primary filter element 51 is relatively coarsely meshed or perforated and is thus suitable for the removal of relatively large-sized dust particles and the secondary filter element 52 is relatively finely meshed or perforated and is suited for the removal of relatively small-sized dust particles. A suitable number of secondary-filter retainer elements 54 project forwardly from the outer face of the front end wall portion 30 of the rotor housing 28 into the space in the secondary filter element 52. The retainer elements 54 are adapted to retain the secondary filter element 52 in position relative to the dust receptacle 43 and thus prevent the filter element 52 from being excessively moved away from the front end portion of the primary filter element 51 when the secondary filter element 52 is moved rearwardly by the suction established posterior to the filter element 52.

Though not shown, the front tubular portion 44 of the dust receptacle 43 is connected by a flexible hose to a suitable cleaning nozzle or end attachment of the vacuum cleaner, as is well known. Designated by reference numeral 55 is a portion of a cord for providing electrical connection between the motor 20 and a convenience outlet (not shown) for power supply.

When, in operation, the motor 20 connected to a convenience outlet is switched in and drives the rotor 23 of the fan unit 19 for rotation about the axis thereof, suction is developed in the dust receptacle 43 so that the one-way check valve 46 is warped into the position opening the inner end of the suction hole 45 in the front tubular portion 44 of the receptacle 43 as indicated by the phantom lines. When the cleaning nozzle attached to the hose leading from the tubular portion 44 is then moved to pass over the surface to be cleaned, dust laden air is admitted past the one-way check valve 46 into the dust receptacle 43. The dust laden air thus sucked into the receptacle 43 is further drawn by the suction established on the leeward side of the primary and secondary filter elements 51 and 52 so that the relatively large-sized dust particles in the dust laden air are collected by the primary filter element 51 and the relatively fine dust particles are filtered out by the secondary filter element 52 as the dust laden air is passed through the primary and secondary filter elements 51 and 52. The air thus cleaned out is admitted into the fan unit 19 through the air inlet opening 32 in the rotor housing 28.

The axial flow of air entering the central opening 27 in the rotor 23 from the opening 32 in the rotor housing 28 is caused to make a right-angle bend to get into each of the passageways between the rotor blades 26 and produces spiral flows of air radially outwardly from the central opening 27. The spiral air flows are delivered tangentially from the radially outer ends of the rotor blades 29 and are collected in the annular passageway 31 surrounded by the cylindrical side wall portion 29 of the rotor housing 28 as the rotor 23 is driven to rotate about its axis by the motor 20. The flow of air in the annular passageway 31 then enters the individual passageways between the stationary guide vanes 41 on the leeward side of the rotor 23 and is forced into the cylindrical air outlet passageway 38 downstream of the guide vanes 41 by the back pressure established on the windward side of the vanes 41 while swirling about the rearward extension of the axis of rotation of the rotor 23. The spinning flows of air are then discharged from the outlet passageway 38 through the openings (not shown) provided in the motor housing 35 and further from the cleaner casing 11 into the atmosphere through the opening or openings (not shown) provided in a wall portion of the body 12 of the casing 11.

When the flows of air given a spinning tendency by the guide vanes 41 are admitted into the air outlet passageway 38 between the motor 20 and the cylindrical wall portion 37 of the motor housing 35, the flows are no longer subjected to compulsive spinning actions in the absence of guide means on the leeward side of the guide vanes 41. The streams of air flowing through the air outlet passageway 38 are thus disrupted by various projecting parts (not shown) of the motor 20 and produce turbulent flows in the passageway 38, as indicated by arrows *a* in FIG. 2. The turbulent flows cause noises and give rise to deterioration of the performance efficiency of the fan unit 19. FIGS. 3 and 4 illustrate a preferred embodiment of the present invention to eliminate such a problem inherent in the air exhausting unit 18 of prior art.

In FIG. 3, the motor 20 is shown to be a commutator motor largely comprising an armature 56 rotatable with the output shaft 21, a field-pole iron 57 fixed to the motor bracket 22 by bolts 58 (only one of which is shown), a commutator assembly 59 and front and rear bearing units 60 and 60′ supporting the shaft 21 as is customary.

In lieu of the motor housing 35 of the prior art air exhausting unit 18 of the vacuum cleaner illustrated in FIG. 1, the embodiment of FIGS. 3 and 4 has a housing structure 61 comprising a bracket 62 of a rigid plastic and a cylindrical enclosure 63 of a sound and shock absorbing material such as foams of polyurethane. The bracket 62 has a center axis substantially in line with the axis of the output shaft 21 of the motor 20 and accordingly with the axis of rotation of the rotor 23 and consists of an annular rim portion 64 fixedly connected at its entire outer circumference to the rear end of the cylindrical side wall portion 29 of the rotor housing 28 by an adhesive and outer and inner wall portions 65 and 66 located in the previously mentioned cylindrical air outlet passageway 38 around the motor 20. The outer cylindrical portion 65 extends axially rearwardly from the inner circumference of the rim portion 64, and the inner cylindrical portion 66 is radially inwardly spaced apart from the outer cylindrical portion 65. The rim portion 64, and the outer and inner cylindrical portions 65 and 66 are arranged substantially coaxially about the center axis of the bracket 62. As better seen in FIG. 4, the outer and inner cylindrical portions 65 and 66 are integrally connected together by means of a plurality of guide vanes 67 which are arranged substantially symmetrically about the center axis of the bracket 62 and accordingly the rearward extension of the axis of rotation of the rotor 23. The individual guide vanes 67 have cross sections extending generally radially about the center axis of the bracket 62 and are curved forwardly in the direction of rotation of the rotor and slightly inclined with respect to the center axis of the bracket 62 so that each of the guide vanes 67 has an upstream axial end located forwardly of its downstream axial end in the direction of rotation of the rotor 23. The guide vanes 67 are substantially equiangularly spaced apart from each other about the center axis of the bracket 62 and have formed therebetween a plurality of separate passageways 68 which communicate upstream with the annular passageway 31 around the rotor 23 through the passageways between the guide vanes 41. The cylindrical enclosure 63 of shock and sound absorbing material has a front end portion fixed to the outer peripheral surface of the outer cylindrical portion 65 of the bracket 62 and coaxially surrounds the cylindrical outlet passageway 38 around the motor 20 and the motor bracket 22 as shown in FIG. 3.

With the additional or second guide vanes 67 thus provided downstream of the first guide vanes 41, the spinning tendency of the spiral flows of air passed through the first guide vanes 41 is attenuated when the air is passed through the passageways 68 between the second guide vanes 67. The flows of air through the passageways 68 are, furthermore, generally curvilinear with respect to the center axis of the bracket 62 and are therefore subjected to no turbulent motion. The noises produced within the motor housing structure 61 are, thus, reduced to a minimum in the absence of turbulent flows in the passageways 68. The noises and vibrations inherently produced by the operation of the motor 20 are damped by the enclosure 63 of the sound and shock absorbing material.

Figure 5:
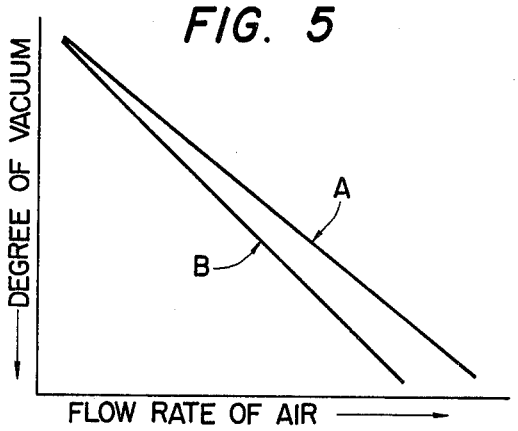
FIG. 5 is a graph showing draft characteristics achieved in the embodiment of FIGS. 3 and 4 and draft characteristics of the air exhausting device incorporated into the vacuum cleaner of FIG. 1.

FIG. 5 illustrates draft characteristics (curve A) of the air exhausting device shown in FIGS. 3 and 4 in comparison with the draft characteristics (curve B) of a prior art air exhausting device having the construction illustrated in FIG. 1, using the flow rate of air through each device as the abscissa and the degree of suction as the ordinate. From comparison between the curves A and B, it will be readily seen that the air exhausting device embodying the present invention is capable of producing a greater amount of draft than in the prior art air exhausting device although a higher degree of suction is achieved in the latter. This will be accounted for by the fact that the performance efficiency of the fan unit 19 in the embodiment of FIGS. 3 and 4 is increased as a consequence of the reduction of the turbulent flows downstream of the fan unit 19.

Figure 6:
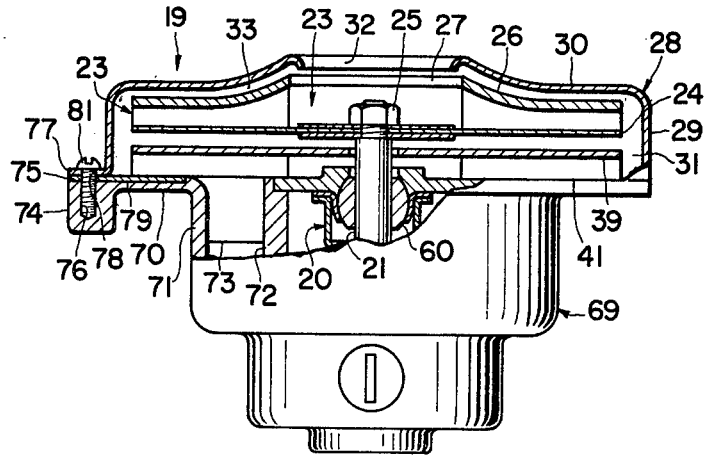
FIG. 6 is a partially cutaway view showing a second preferred embodiment of the present invention.
Figure 7:
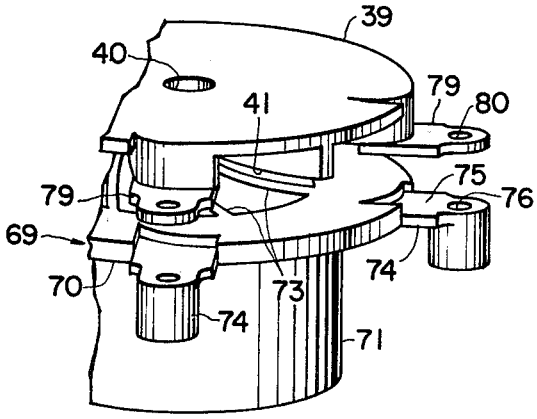
FIG. 7 is a fragmentary perspective view showing part of the embodiment illustrated in FIG. 6.

Turning back to FIG. 2, the guide vanes 41 provided in a prior art air exhausting device are fixed to the motor housing 35 by means of the fittings projecting from the vanes such as the leg portions 42 forming part of the vanes 41 as previously noted. The leg portions 42 or similar members are located within the passageways between the guide vanes 41 and tend to disrupt the flows of air being passed through the passageways as indicated by arrows *b*, providing other causes of noises and turbulent flows in the air exhausting device. FIGS. 6 and 7 illustrate a preferred embodiment of the present invention to eliminate such a problem by establishing streamlined paths in the individual passageways between the guide vanes 41.

Referring to FIGS. 6 and 7, the air exhausting device embodying the present invention comprises a motor housing 69 consisting of a generally annular rim portion 70, an outer cylindrical portion 71 extending axially rearwardly from the inner circumference of the rim portion 70, an inner cylindrical portion 72 radially inwardly spaced apart from the outer cylindrical portion 71, and a plurality of second guide vanes 73 integrally interconnecting the outer and inner cylindrical portions 71 and 72. The outer and inner cylindrical portions 71 and 72 are arranged substantially similarly to their counterparts of the bracket 62 of the motor housing structure 61 of the embodiment of FIGS. 3 and 4. The second guide vanes 73 are essentially similar to their counterparts of the embodiment of FIGS. 3 and 4 but are herein assumed to terminate halfway of the cylindrical portions 71 and 72. The annular rim portion 70 of the housing 69 is provided with a suitable number of radial projections 74 extending radially outwardly from the outer circumference of the rim portion and has formed in its front wall depressions 75 having flat bottom faces located at the downstream end of the annular passageway 31 around the rotor 23 and which are flush with and merge into the front end faces of the radial projections 74, respectively. Each of the projections 74 has an internally threaded hole 76 extending in parallel with the center axis of the motor housing 69 and having an open end at the front end face of the projection. Similarly to the motor housing 69 thus formed with the radial projections 74, the rotor housing 28 is formed with radial projections 77 extending radially outwardly from the rear end of the cylindrical side wall portion 29 thereof and arranged in correspondence with the radial projections 74 of the motor housing 69 as shown in FIG. 6 wherein only one of the projections 77 is shown. Each of the projections 77 thus formed on the rotor housing 28 has an internally threaded through hole 78 in line with the internally threaded hole 76 in each of the projections 74 of the motor housing 69. The guide vanes 41 of the same number as the radial projections 74 on the motor housing 69 are formed with substantially flat leg portions 79 partially bent substantially perpendicularly from the rear ends of radially outer end portions of the guide vanes and partially projecting radially outwardly from the radially outer ends of the guide vanes, as will be better seen in FIG. 7. Each of the leg portions 79 has the thickness substantially equal to the depth of each of the depressions 75 in the rim portion 70 of the motor housing 69 and is shaped to be identical partly with the bottom face of each depression 75 and partly with the front end face of each of the radial projections 74 of the motor housing 69. When the motor housing 28 is assembled to the motor housing 69, each of the leg portions 79 of the former is closely received partly in each of the depressions 75 and partly on the front end face of the projections 74 of the latter with its front end face substantially flush with the front end face of the annular rim portion 70 of the motor housing 69. The leg portions 79 are formed with holes 80 arranged in correspondence with the internally threaded holes 76 and 78 in the motor and rotor housings 69 and 28 so that the housings 28 and 69 and the guide vane structure consisting of the disc member 39 and the guide vanes 41 are fixedly secured together by means of screws 81 which are passed through the aligned holes 76, 80 and 78 with each of the leg portions 79 of the guide vanes 41 closely interposed between each of the radial projections 74 of the motor housing 69 and the radial projection 77 of the rotor housing 28 as shown in FIG. 6.

With the guide vanes 41 thus arranged, the leg portions 79 are embedded in the annular rim portion 70 of the motor housing 69 and constitute no projecting part in each of the passageways between the guide vanes 41. The paths of air through these passageways are, thus, completely streamlined and the flows of air admitted to the passageways are not subjected to resistance and are allowed to smoothly move toward the second guide vanes 73.

Figure 8:
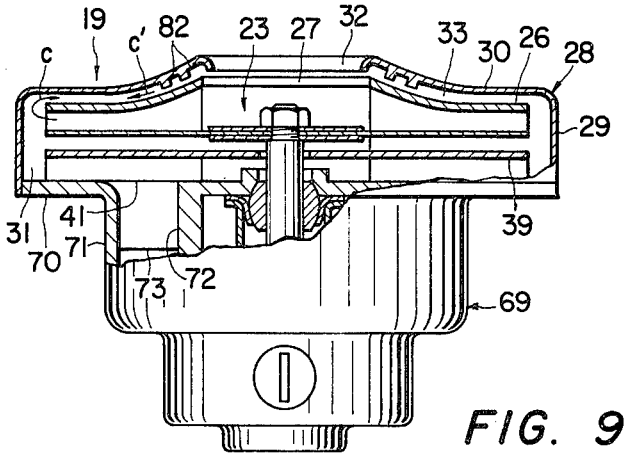
FIG. 8 is a partially cutaway view showing a third preferred embodiment of the present invention.
Figure 9:
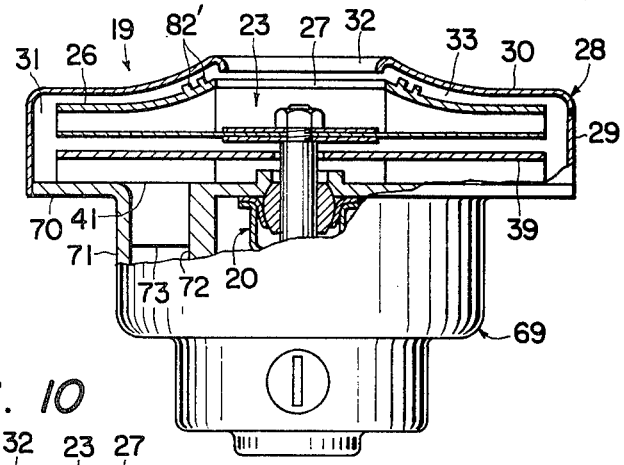
FIG. 9 is a view similar to FIG. 8 but shows a modification of the embodiment of FIG. 8.

Reverting again to FIG. 2, the streams of air delivered tangentially from the circumferential end of the rotor 23 into the annular passageway 31 are allowed to enter the annular clearance 33 between the rotor 23 and the inner surface of the end wall portion 30 of the rotor housing 28 as indicated by an arrow *c* and are sucked for a second time into the central opening 27 in the rotor 23 as indicated by an arrow *d* by reason of the suction established in the opening 27. The recirculation or backflow of air causes reduction of the suction developed at the entrance to the rotor 23 and thus gives rise to deterioration in the performance efficiency of the fan unit 19. FIGS. 8 and 9 illustrate preferred embodiments of the present invention to eliminate such a drawback.

In the embodiment of FIG. 8, the rotor housing 28 has formed on the inner surface of its front end wall portion 30 two circular ribs 82 projecting into the annular clearance 33 between the end wall portion 30 and the rotor 23 and coaxially extending about the center axis of the air inlet opening 32 in the rotor housing 28. The streams of air admitted back into the clearance 33 from the annular passageway 31 are, thus, obstructed by the ribs 82 located in the clearance 33 and tend to flow backwardly toward the annular passageway 31 as indicated by arrow *c'*, cancelling the flows of air entering the clearance 33 from the annular passageway 31. The flow of air from the clearance 33 into the central opening 27 is in this fashion eliminated by the ribs 82 so that an increased suction is developed at the entrance to the rotor 23.

While the ribs 82 are shown to be formed on the end wall portion 30 of the rotor housing 28, similar ribs may be provided on the rotor 23 as indicated by 82' in the embodiment of FIG. 9. In this instance, the rotor 23 may be provided with an annular disc having the rotor blades 26 projecting from its inner surface and having the ribs 82' formed on its outer face.

The ribs 82 or 82' have been shown provided two in number in each of the embodiments of FIGS. 8 and 9 but it is apparent that only one rib or more than two ribs may be provided in the clearance 33, if desired.

Figure 10:
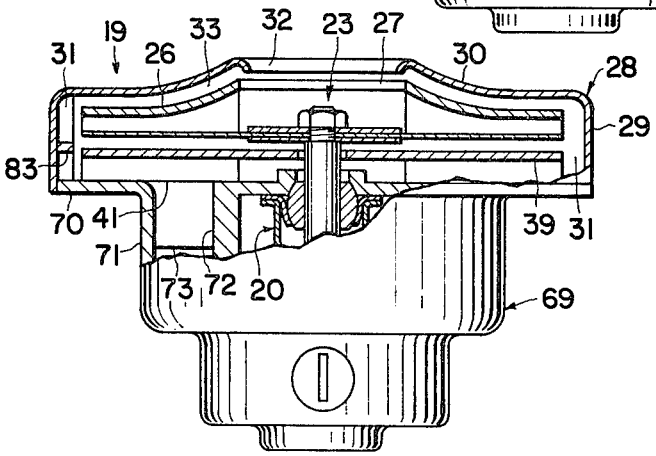
FIG. 10 is a partially cutaway view showing still another preferred embodiment of the present invention.
Figure 10A:
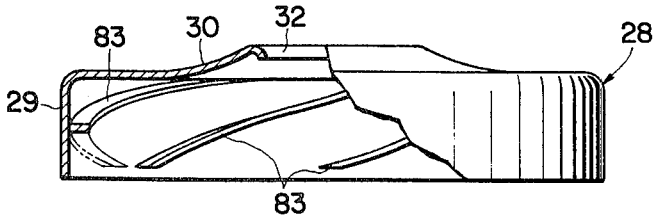
FIG. 10*a* is a partially cutaway fragmentary view showing a rotor housing forming part of the embodiment illustrated in FIG. 10.

Turning further back to FIG. 2, the streams of air splashed from the rotor 23 into the annular passageway 31 are caused to forcefully impinge upon the inner peripheral surface of the side wall portion 29 of the rotor housing 28 as indicated by an arrow *e* and tend to produce turbulent flows in the annular passageway 31. The turbulent flows in turn cause reduction in the velocities of the streams of air toward the guide vanes 41 and deteriorates the performance efficiency of the fan unit 19. FIGS. 10 and 10*a* illustrate a preferred embodiment of the present invention to prevent production of such turbulent flows.

To achieve such an end, the rotor housing 28 of the embodiment illustrated in FIGS. 10 and 10*a* has formed on the inner peripheral surface of its cylindrical side wall portion 29 a plurality of spiral ribs 83 projecting into the annular passageway 31 around the rotor 23 and spirally extending about the axis of rotation of the rotor 23, as will be better seen in FIG. 10*a*. The streams of air tangentially delivered from the rotor 23 into the annular passageway 31 are, thus, caused to spirally flow along the ribs 83 toward the downstream end of the annular passageway 31 and produce no turbulent flows in the passageway 31. By reason of the spiral flows established in the annular passageway 31, the streams of air spurting from the rotor 23 are brought into contact with the inner peripheral surface of the cylindrical side wall portion 29 of the rotor housing 28 in tangential directions of the side wall portion so that there is no loss in the velocities of the streams of air being passed from the rotor 23 to the guide vanes 41.

While some preferred embodiments of the present invention have been described with reference to the drawings, such embodiments are merely for the purpose of illustration of the gists of the present invention and may therefore be modified in numerous manners if desired.

What is claimed is:

1. A fluid exhausting device comprising, in combination, a centrifugal fan unit including a rotor having an axis of rotation and formed with a central opening having a center axis substantially coincident with said axis of rotation and a plurality of rotor blades extending radially outwardly from said central opening and a rotor housing enclosing the rotor and having a generally cylindrical side wall portion defining an annular passageway substantially coaxially surrounding the rotor, said rotor housing having a fluid inlet opening adjacent the central opening in the rotor, a driving unit positioned opposite to said fluid inlet opening across said rotor and drivingly connected to the rotor, a housing structure fixedly secured to the rotor housing and enclosing the driving unit for providing a fluid outlet passageway surrounding at least part of the driving unit, the housing structure being in constant communication with said annular passageway in the rotor housing, and formed with at least one opening through which said outlet passageway is vented to the atmosphere, a plurality of stationary guide vanes located between said annular passageway and said outlet passageway and elongated generally radially away from an extension of said axis of rotation of said rotor, said annular passageway having a portion which is in substantially coaxially surrounding relationship to said first guide vanes, and a plurality of second guide vanes located in said outlet passageway immediately downstream of said first guide vanes and extending generally radially about said extension of the axis of rotation of said rotor.

2. A fluid exhausting device as set forth in claim 1, in which said second guide vanes have cross sections inclined with respect to said center axis of said annular portion so that each of the second guide vanes has its upstream end located forwardly of the downstream end of the guide vane in the direction of rotation of the rotor.

3. A fluid device as set forth in claim 2, in which said cross sections of said second guide vanes are curved forwardly in the direction of rotation of said rotor.

4. A fluid exhausting device as set forth in claim 1, in which said housing structure has an annular portion extending along the downstream end of said side wall portion of said rotor housing and a plurality of radial projections extending radially outwardly from the outer circumference of said annular portion, said annular portion being formed with depressions each having a bottom face located at the downstream end of said annular passageway and substantially flush with and merging into one end surface of each of said radial projections, each of the first guide vanes of the same number as said radial projections having a leg portion partly bent substantially perpendicularly from the downstream end of a radially outer end portion of the first guide vane and partly projecting radially outwardly from the first guide vane, the leg portion having a thickness substantially equal to the depth of each of said depressions and having a configuration substantially identical partly with the bottom face of each depression and partly with said end face of each of said radial projections, each of the leg portions being partly received in each of said depressions and partly received on said end face of each of said radial projections.

5. A fluid exhausting device as set forth in claim 4, in which said rotor housing further has radial projections extending radially outwardly from the downstream end of said side wall portion, said radial projections of said housing structure being fixedly connected to said radial projections of said rotor housing with the radial ends of said leg portions interposed therebetween.

6. A fluid exhausting device as set forth in claim 1, further comprising at least one annular rib located within said annular clearance.

7. A fluid exhausting device as set forth in claim 6, in which said annular rib is formed on the inner surface of said end wall portion of said rotor housing.

8. A fluid exhausting device as set forth in claim 6, in which said rib is formed on said rotor.

9. A fluid exhausting device as set forth in claim 6, in which said rib extends substantially coaxially about the center axis of the rotor housing.

10. A fluid exhausting device as set forth in claim 1, in which said rotor housing is formed with a plurality of spiral ribs on the inner peripheral surface of said side wall portion, said spiral ribs extending about the axis of rotation of said rotor.

11. A fluid exhausting device as set forth in claim 1, in which said first guide vanes are curved forwardly in the direction of rotation of said rotor.

12. A fluid exhausting device as set forth in claim 1, in which said first guide vanes are spaced apart from each other in a circumferential direction about said extension of the axis of rotation of said rotor defining therebetween radially elongated passageways open at their radially outer ends to said annular passageway and at downstream axial ends opposite to said rotor to said fluid outlet passageway, and which are separate from each other in said circumferential direction within said rotor housing.

13. A fluid exhausting device as set forth in claim 1, in which said second guide vanes are spaced apart from each other circumferentially about said extension of the axis of rotation of said rotor defining therebetween passageways each contiguous at one end to said first guide vanes and separate from each other in said circumferential direction about said extension of the axis of rotation of said rotor.

14. A fluid exhausting device as set forth in claim 1, in which said first guide vanes are substantially equiangularly spaced apart from each other about said extension of the axis of rotation of said rotor.

15. A fluid exhausting device as set forth in claim 1, in which said fluid outlet passageway has a generally annular portion contiguous to said first guide vanes and having a center portion contiguous to said first guide vanes and having a center axis substantially in line with said extension of the axis of rotation of said rotor, and said second guide vanes extending generally radially throughout said annular portion about said center axis of the annular portion.

16. A fluid exhausting device as set forth in claim 15, in which said second guide vanes are arranged substantially summetrically with respect to said center axis of said annular portion.

17. A fluid exhausting device as set forth in claim 13, in which said housing structure comprises a bracket including radially spaced outer and inner cylindrical portions defining said annular portion of said outlet passageway therebetween.

18. A fluid exhausting device as set forth in claim 17, in which said housing structure further comprises a cylindrical enclosure of a sound and shock absorbing material fixed to said outer cylindrical portion and surrounding said driving unit across a portion of said fluid outlet passageway.

19. A fluid exhausting device as set forth in claim 18, in which said cylindrical enclosure is constructed of foams of synthetic resin.

20. A fluid exhausting device as set forth in claim 19, in which said synthetic resin is polyurethane.

21. A fluid exhausting device as set forth in claim 17, in which said second guide vanes are fixedly connected between said outer and inner cylindrical portions.

22. A fluid exhausting device as set forth in claim 21, in which said driving unit is positioned substantially coaxially within said inner cylindrical portion of said bracket and is securely connected to said inner cylindrical portion so that the driving unit is supported by said housing structure.

23. A fluid exhausting device as set forth in claim 22, in whcih said second guide vanes are spaced apart from each other in circumferential direction about said center axis of said annular portion of said outlet passageway defining therebetween passageways each contiguous at one end to said first guide vanes and separate from each other in said circumferential direction about said center axis of said inner cylindrical portion of said outlet passageway.

24. A fluid exhausting device as set forth in claim 23, in which said first guide vanes are spaced apart from each other in a circumferential direction about said extension of the axis of rotation of said rotor defining therebetween radially elongated passageways open at their radially outer ends to said annular passageway and downstream axial ends opposite to said rotor to said passageways between said second guide vanes, and which are separate from each other at said circumferential direction about said extension of the axis of rotation of said rotor.

* * * * *